US006860439B2

(12) United States Patent
Balachandran et al.

(10) Patent No.: US 6,860,439 B2
(45) Date of Patent: Mar. 1, 2005

(54) ELECTROSTATIC SPRAYING OF A COSMETIC COMPOSITION

(75) Inventors: Wamadeva Balachandran, Uxbridge (GB); Susan Michelle Kutay, Bebington (GB); Peng Miao, Uxbridge (GB); Richard Leslie Wright, Bebington (GB)

(73) Assignee: Unilever Home & Personal Care USA, division of Conopco, Inc., Chicago, IL (US)

( * ) Notice: Subject to any disclaimer, the term of this patent is extended or adjusted under 35 U.S.C. 154(b) by 104 days.

(21) Appl. No.: 10/231,422

(22) Filed: Aug. 29, 2002

(65) Prior Publication Data

US 2003/0164417 A1 Sep. 4, 2003

(30) Foreign Application Priority Data

Mar. 1, 2002 (WO) ..... PCT/GB02/00898

(51) Int. Cl.[7] ..... B05B 5/00

(52) U.S. Cl. ..... 239/690; 239/568; 239/597; 239/601; 239/698

(58) Field of Search ..... 239/568, 597, 239/598, 599, 601, 690.1, 691, 692, 693, 694, 695, 696, 697, 698, 699, 700, 701, 702, 703, 704, 705; 128/203.12, 203.14, 213, 214

(56) References Cited

U.S. PATENT DOCUMENTS

| | | | | |
|---|---|---|---|---|
| 4,009,829 A | * | 3/1977 | Sickles | 239/690.1 |
| 4,316,914 A | | 2/1982 | Coffee et al. | |
| 4,356,528 A | | 10/1982 | Coffee | |
| 4,358,059 A | | 11/1982 | Coffee | |
| 4,421,281 A | | 12/1983 | Coffee et al. | |
| 4,476,515 A | * | 10/1984 | Coffee | 361/226 |
| RE31,927 E | | 6/1985 | Coffee et al. | |
| 5,184,778 A | * | 2/1993 | Noakes | 239/691 |
| 5,268,166 A | | 12/1993 | Barnett et al. | |
| 5,322,684 A | | 6/1994 | Barnett et al. | |
| 5,368,237 A | * | 11/1994 | Fulkerson | 239/706 |
| 5,490,633 A | | 2/1996 | Jeffries et al. | |
| 5,494,674 A | | 2/1996 | Barnett et al. | |
| 5,566,042 A | * | 10/1996 | Perkins et al. | 361/228 |
| 5,927,618 A | * | 7/1999 | Jefferies et al. | 239/690.1 |
| 5,975,425 A | * | 11/1999 | Carlton | 239/3 |
| 5,997,759 A | | 12/1999 | Trinh et al. | |
| 6,194,027 B1 | * | 2/2001 | Mauchle | 427/180 |
| 6,252,129 B1 | | 6/2001 | Coffee | |
| 6,318,640 B1 | | 11/2001 | Coffee | |

FOREIGN PATENT DOCUMENTS

| | | |
|---|---|---|
| EP | 0 057 324 | 12/1981 |
| EP | 0 086 030 | 2/1982 |
| EP | 0 468 736 | 3/1997 |
| EP | 0 441 501 | 8/1997 |
| EP | 0 486 198 | 2/2001 |
| WO | 01/89708 | 11/2001 |

* cited by examiner

*Primary Examiner*—Binh Q. Tran
(74) *Attorney, Agent, or Firm*—Milton L. Honig

(57) ABSTRACT

A personal product comprising a liquid cosmetic composition and a hand-held electrostatic spraying device suitable for applying the composition to the human body, said hand-held electrostatic spraying device comprising a slit nozzle having a maximum width of from 0.05 mm to 0.5 mm, means for containing the liquid cosmetic composition, means for supplying the liquid cosmetic composition to the nozzle, an electricity source, high voltage circuitry arranged so that, in use, liquid cosmetic composition sprayed in atomised form from the nozzle is electrically charged, and control means for selectively applying a high voltage.

21 Claims, 5 Drawing Sheets

ELECTROSTATIC SPRAYING OF A COSMETIC COMPOSITION

Figure 1:
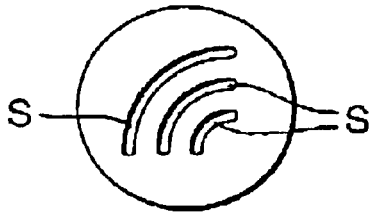

The present invention relates to a personal product that enables the application of a liquid cosmetic composition to the human body, the product comprising a hand-held electrostatic spraying device having a slit nozzle design that enables excellent spray quality at high spray rates.

Electrostatic spraying devices work by passing a stream of liquid through a nozzle held at high voltage relative to a counter-electrode, said high voltage causing electrostatic charging and atomisation of the liquid exiting the nozzle. Numerous potentially hand-held electrostatic spraying devices have been described in the patent literature; for example, EP 441,501 B1 (Noakes, 1997), EP 468,736 B1 (Noakes and Reed, 1997), and EP 486,198 B1 (Noakes, 2001). A problem encountered with most of the devices described in the literature is that only relatively low spray rates may be achieved, particularly when a high quality spray is desired.

Higher spray rates are achieved with certain agricultural electrostatic spraying devices, where the quality of the spray achieved is usually less critical. Such devices are described in EP 86,030 A1 (Coffee et al), U.S. Pat. No. 4,421,281 (Coffee and Bennett), and U.S. Pat. No. 4,358,059 (Coffee). A common feature in these devices is the presence of a nozzle having an annular alit orifice, although the width of the slit is not generally disclosed and the devices described are not hand-held devices of the sort that would be suitable for use in the application of cosmetic compositions to the human body.

In a first aspect of the present invention, there is provided a personal product comprising a liquid cosmetic composition suitable for application to the human body and a hand-held electrostatic spraying device suitable for applying a liquid cosmetic composition to the human body, said hand-held electrostatic spraying device comprising a slit nozzle having a maximum width of from 0.05 mm to 0.5 mm, means for containing the liquid cosmetic composition, means for supplying the liquid cosmetic composition to the nozzle, an electricity source, high voltage circuitry arranged so that, in use, liquid cosmetic composition sprayed in atomised form from the nozzle is electrically charged, and control means for selectively applying a high voltage.

In a second aspect of the present invention, there is provided a method of spraying the human body with a liquid cosmetic composition, comprising the use of a hand-held electrostatic spraying device as described in the first aspect of the invention, to spray the human body with a liquid cosmetic composition.

The present invention enables high fluid output and good spray quality to be achieved with a variety of cosmetic compositions. Suitable compositions have a resistivity of from $10^4$ Ω.cm to $10^8$ Ω.cm, in particular from $10^6$ Ω.cm to $10^7$ Ω.cm. The benefit of high fluid output and good spray quality is of great advantage in the application of liquid cosmetic compositions to the human body. Consumers greatly desire the rapid application of product achievable at high flow rates and the good spray quality gives a comfort in use benefit not relevant to the use of electrostatic spraying devices in other fields. Poor quality sprays, comprising large droplets, often feel cold and wet on application to the human body.

Liquid cosmetic compositions used with the device of the present invention frequently comprise a C2 to C4 alcohol, for example ethanol, propylene glycol, propanol, or isopropanol. Particularly good sensory benefits may be achieved when such compositions are used. Suitable compositions typically comprise C2 to C4 alcohol at a level of from 5% to 95%, in particular from 25% to 80%, and especially from 40% to 75% by weight of the composition. Liquid compositions comprising ethanol are particularly suitable.

The composition may also comprise water in an amount from 0.1% to 50% by weight of the composition. In such compositions the weight ratio of C2 to C4 alcohol to water is preferably 1:1 or greater, more preferably 3:2 or greater, and most preferably 4:1 or greater. The higher alcohol ratios give the benefit of improved sensory properties for the consumer, particularly reduced wet feeling.

Suitable cosmetic compositions include hair sprays, body sprays, deodorants, antiperspirants, and perfumes. Body sprays are particularly suitable because the electrically charged nature of the spray generated can enable the spray to "wrap around" the body and give a pleasant sensory property.

High fluid outputs, for example from 30 ml/h to 500 ml/h, and, in particular, from 100 ml/h to 200 ml/h, can be achieved, whilst still maintaining good spray quality. Spray quality may be defined by the fineness of the droplets achieved and/or by the narrowness of the droplet size distribution of said droplets. For many applications, it desirable to achieve a Sauter D(3,2) mean droplet size of from 1 μm to 100 μm, in particular from 5 μm to 50 μm, and especially from 5 μm to 25 μm. It is further preferred that for each of the Sauter D(3,2) preferred ranges indicated above, that the Sauter D(4,3) mean droplet size is also within the same range. With regard to the width of the droplet size distribution, it is preferred that 90% by volume of the droplets are from 1 μm to 100 μm, in particular from 3 μm to 50 μm, and especially from 5 μm to 25 μm.

Moving on to the nature of the electrostatic spraying device, the nozzle is of critical importance. The nozzle of is a slit nozzle, that is to say, the nozzle has an elongated cross-section orthogonal to the general direction of movement of the liquid through the nozzle. This means that the length of the nozzle is significantly greater than its width, for example the length may be 2 or 3 times greater than its width. Preferably, the slit nozzle has a ratio of length to width of from 10:1 to 500:1, more preferably this ratio is from 100:1 to 500:1. Preferably the slit nozzle has outwardly curved ends, in order to improve spray quality. For the avoidance of doubt, the ends of the slit are those edges of the slit spanning the width of the slit. Also to improve spray quality, it is preferred that the slit nozzle is of uniform width along substantially its entire length.

In particularly preferred embodiments, the slit nozzle is curved along its length. It is especially preferred that the nozzle has the form of an annular slit. When the nozzle has this latter form, it has no "ends" and it is preferred that the annular slit is of uniform width along its entire length.

Figure 2:
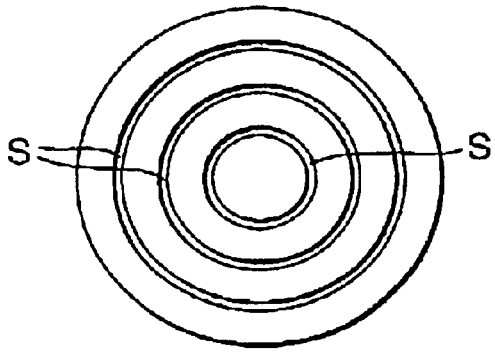

In certain embodiments, more than one nozzle is present. When more than one alit nozzle curved along its length is present, a preferred arrangement is that the curved slits sit one inside the other, decreasing in length accordingly and each having the same radius of curvature. FIG. 1 represents a front view of such a multiple nozzle arrangement, where each of the curved slits is outwardly curved at its ends. Areas "S" represent the nozzle slits and the surrounding areas represent the material that defines the slits. When more than one annular slit nozzle is present, a preferred arrangement is that the annular slits are concentric, one within the other; a front view of such a multiple nozzle arrangement is represented by FIG. 2 (labelling as FIG. 1).

The width of the slit is a key parameter for the effective functioning of the electrostatic spray device of the present invention. It is essential that this width is from 0.05 mm to 0.5 mm; particularly from 0.2 m to 0.4 mm, and especially 0.3 mm.

The length of the slit is preferably from 0.2 mm to 200 mm, more preferably from 1 mm to 100 mm, and most preferably from 10 mm to 60 mm. When the nozzle has the form of an annular slit, the length of the slit may be calculated from its diameter, which is preferably from 1 mm to 50 mm, more preferaby from 5 mm to 30 mm, and most preferably from 10 mm to 20 mm. When the slit nozzle is curved along its length, figures relating to the length of the slit should be measured along or from the inner edge of curve.

Any suitable means for containing the liquid cosmetic composition and supplying it to the nozzle may be employed. Examples of suitable supply means include use of positive pressure, for example as described in WO 94/11119; pump arrangements, for example as described in EP 558,186; or simple gravity fed systems, for example as described in U.S. Pat. No. 4,356,528.

The high voltage circuitry that is used to electrically charge the liquid that is sprayed in atomised form from the nozzle may be of various designs. Numerous suitable high voltage circuitry systems are described in the prior art (vide supra) and the selection of said system is not crucial to the present invention. Typical voltages usable according to the present invention are from 1 kV to 30 kV. In preferred embodiments, the circuitry is able to charge the nozzle of the electrostatic spraying device to a voltage of 15 kV or greater, especially 25 kV or greater. With suitable circuitry, a commercially available 9 V battery may be used to act as the electricity source. Other possible sources include solar cells and capacitors.

The control means for selectively applying the high voltage may be selected from any of those known in the art; for example, triggers and buttons suitably connected to the high voltage circuitry.

An additional desirable feature is the presence of an earthed ring electrode that surrounds the slit nozzle when viewed in the plane orthogonal to the general direction of movement of the liquid through the nozzle. Preferably said electrode is located close to the exit orifice of the slit electrode, in particular within 30 mm and especially within 15 mm. Preferably said electrode is of diameter from 30 mm to 100 mm, in particular from 50 mm to 75 mm. When the slit nozzle is an annular slit nozzle, it is preferred that the diameter of the ring electrode is from 2 to 4 times that of the annular slit nozzle.

Figure 3:
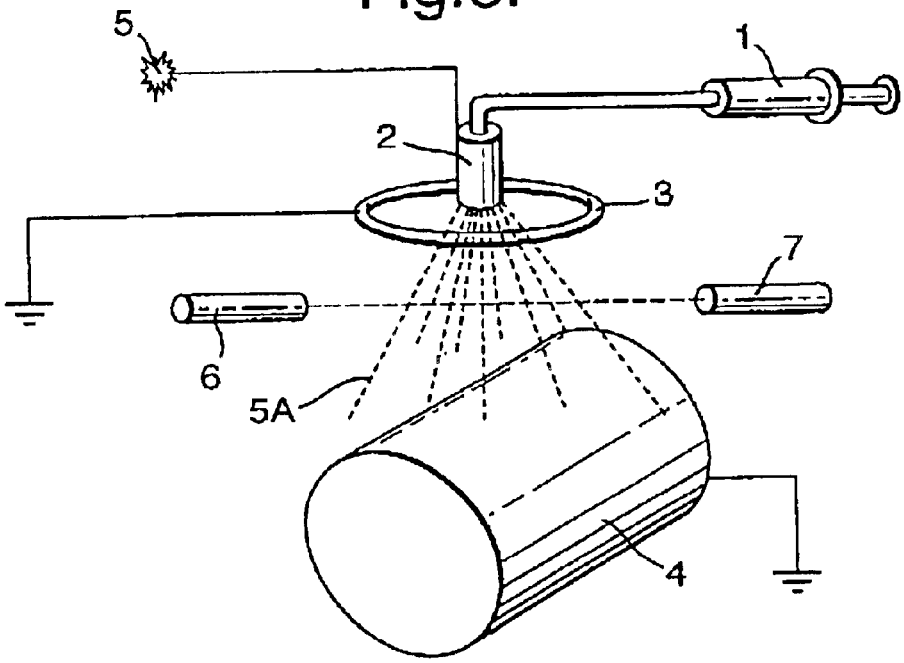

The benefits obtained with an electrostatic spray device according to the invention are illustrated, by way of example, in the following model studies. The set-up of the apparatus used for these studies is shown schematically in FIG. 3. In these studies, we used a simple electric pump (1) to feed ethanol through an annular slit nozzle (2) of width 0.3 mm and diameter 19 mm. A ring electrode (3) of diameter 58 mm, made of 3 mm thick copper wire, was positioned 26 mm above the nozzle and a grounded metallic plate (4), of cylindrical shape, was positioned 150 mm above the nozzle (2). Voltages of between 15 kV and 30 kV were applied between the nozzle (2) and the ring electrode (3), which was also grounded, using a high voltage source (5). Flow rates of from 100 ml/hr to 200 ml/hr were used and the droplet size distribution of the resulting spray (5A) was analysed using a laser diffraction technique (Malvern sizer, the laser detector (6) and source (7) being shown schematically in FIG. 3).

Figure 4:
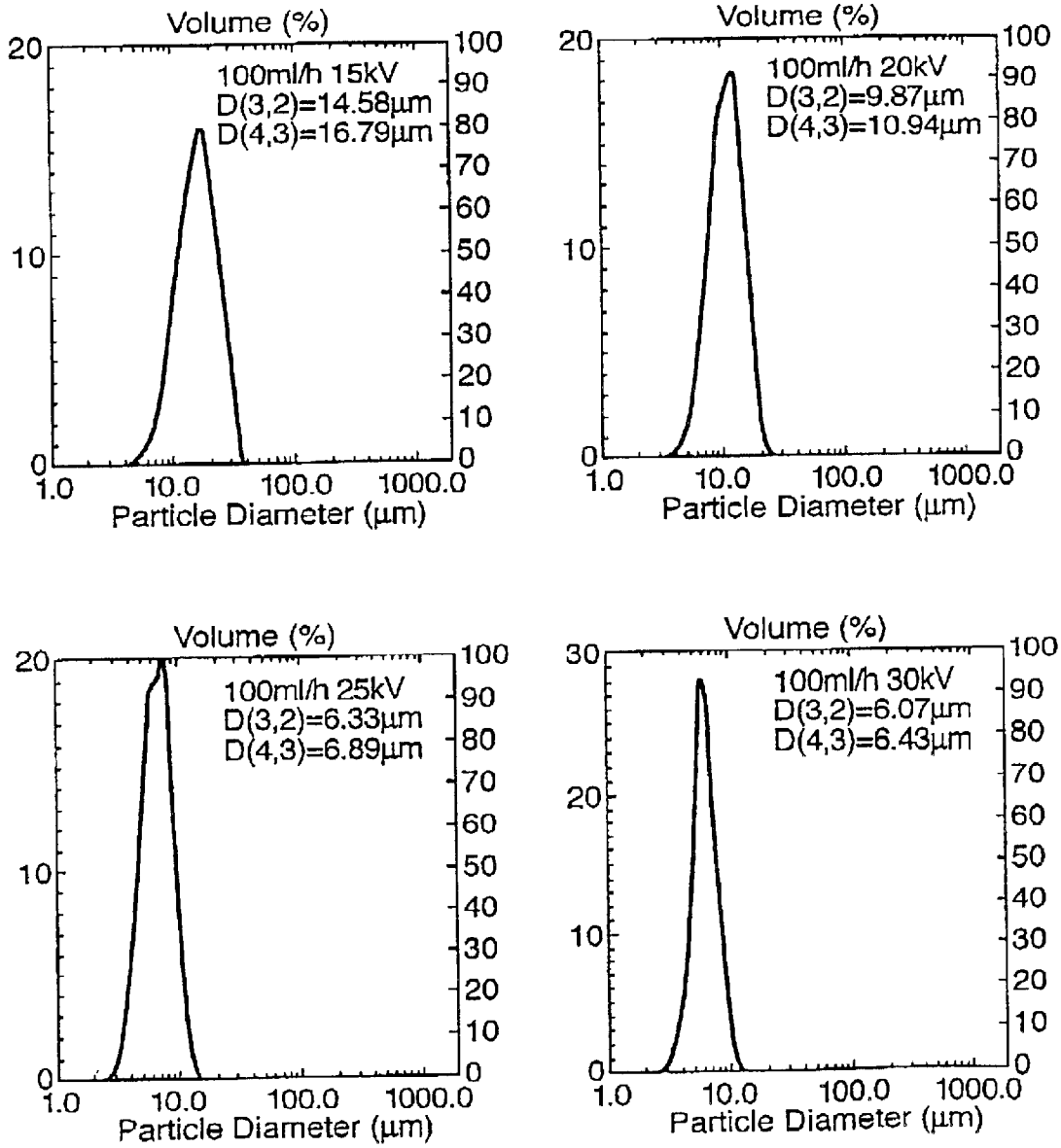
Figure 5:
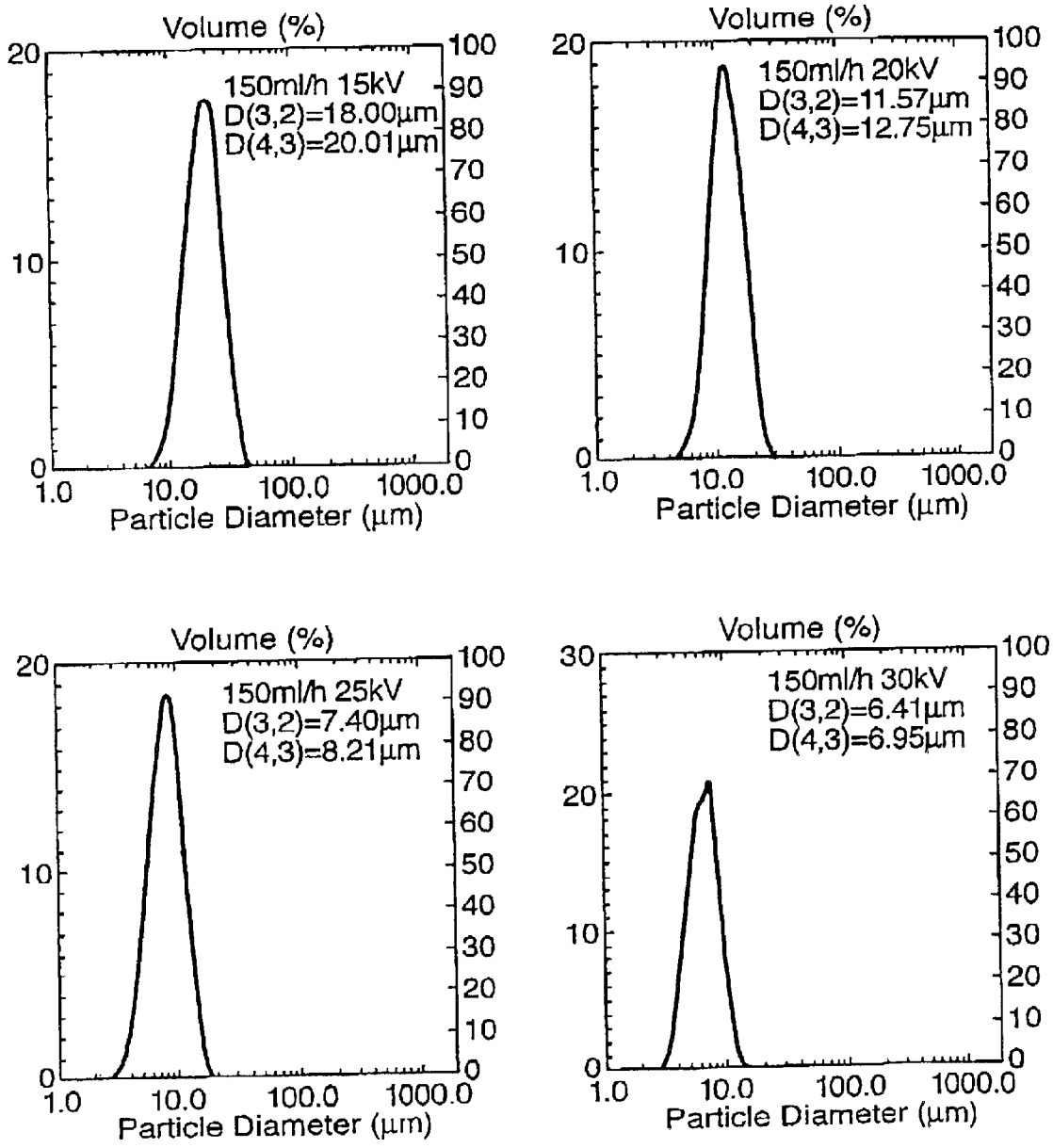
Figure 6:
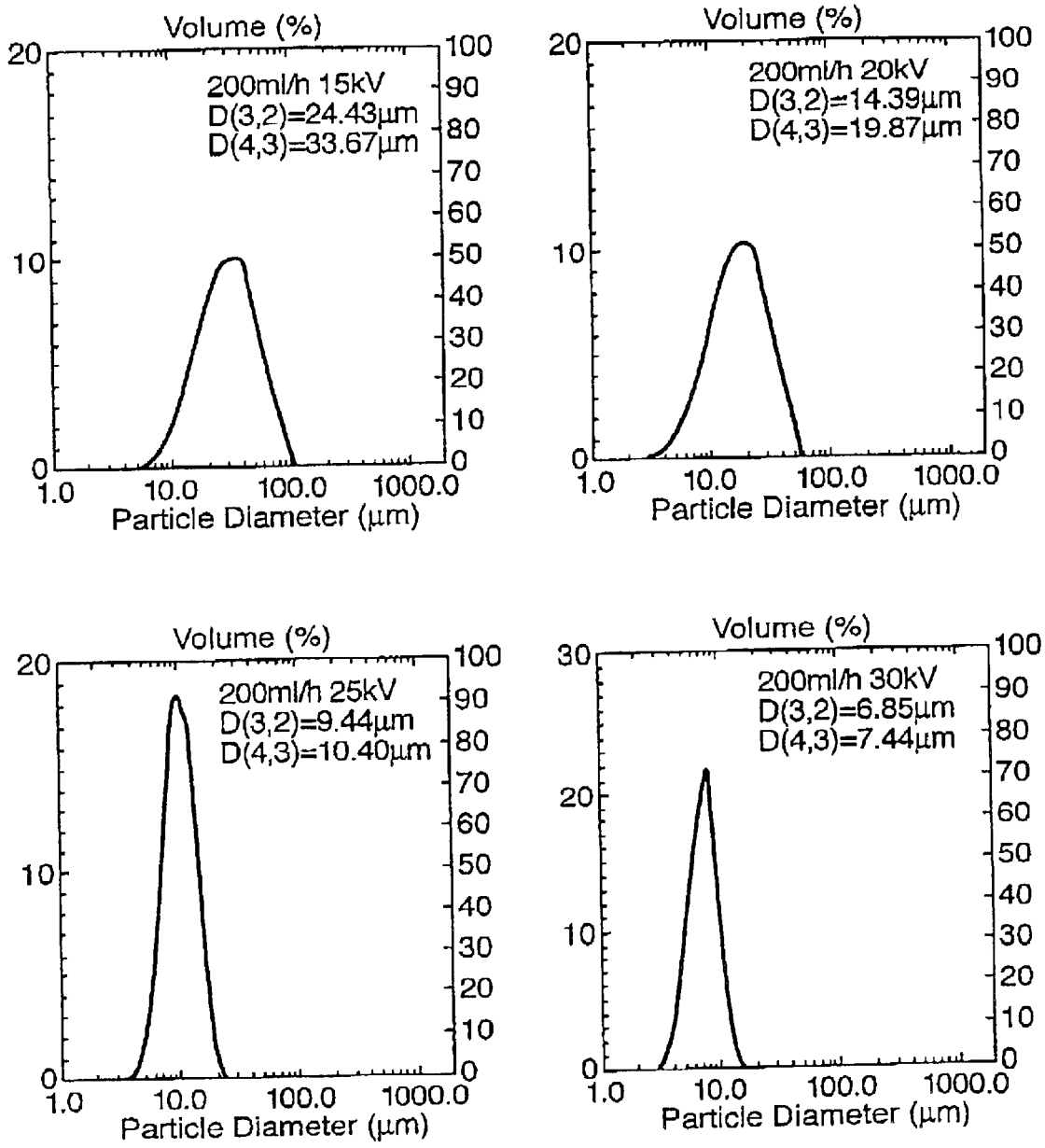

The results are shown in Table 1 and FIGS. 4 to 6. It will be noted from Table 1 that the Sauter mean droplet size D(3,2) is always between 6 $\mu$m and 25 $\mu$m. Extremely narrow droplet size distributions were achieved (see FIGS. 2 to 4), despite the use of the high flow rates indicated. The Figures indicate the Sauter D(4,3) sizes in addition to the D(3,2) sizes. The Figures clearly illustrate that narrower droplet size distributions are achieved at higher voltages (25 kV and greater), particularly at the highest flow rate studied (200 ml/hr)

TABLE 1

| Spray quality (mean droplet size) | | | |
|---|---|---|---|
| | Flow rate | | |
| Voltage | 100 ml/hr | 150 ml/hr | 200 ml/hr |
| 15 kV | 14.6 | 18.0 | 24.3 |
| 20 kV | 9.9 | 11.6 | 14.4 |
| 25 kV | 6.3 | 7.4 | 9.4 |
| 30 kV | 6.1 | 6.4 | 6.9 |

The figures quoted in the Table are Sauter mean droplet sizes D(3,2) in $\mu$m, rounded to 1 decimal place.

These results are illustrative of the surprisingly high quality spray that may be achieved at high flow rates by utilisation of the present invention.

The nozzle design crucial to the present invention may be used in combination with a variety of known electrospray device features. A typical embodiment is illustrated with reference to FIG. 7.

Figure 7:
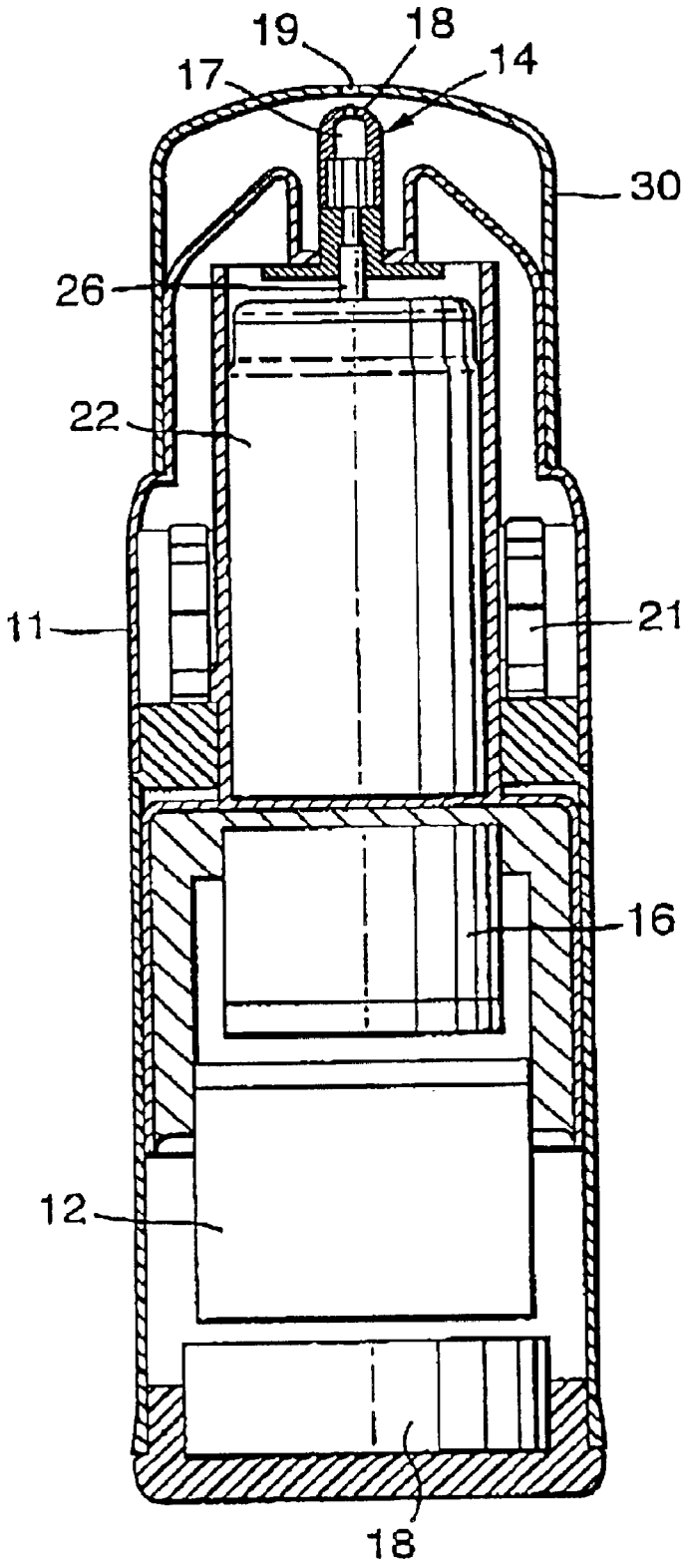

In FIG. 7, the spraying device is constructed with a similar size, shape and weight to a conventional aerosol spray, so as to form a hand-held unit which is easy to manipulate and use and suitable for personal use. The device comprises an elongate housing 11, which is preferably electrically insulating, e.g. of a plastics material, within which the electrical and other hardware components of the device are mounted.

Towards the base of the device is housed a battery 18, such as a conventional low voltage, e.g. 1.5 to 12, particularly 9, volts, cell, which location allows ready access to the battery for the purpose of replacement when necessary. Indicated by numeral 16 is a high voltage generator, which is high voltage circuitry that converts the low voltage from the battery 18 into the high voltage of for example between about 15 and 30 kilovolts, which is required for raising the cosmetic composition to be sprayed to the high electric potential necessary to effect electrostatic spraying thereof. Suitable components of the high voltage generator 16 are well known in the art and comprise principally a coil or transformer to perform the voltage step-up function. If desired or as necessary, various packing elements of electrically insulating material, may be provided in order to increase the safety aspect of the high voltage apparatus and to reduce unwanted leakage paths to earth when the apparatus is in use.

Connected between the battery 18 and high voltage generator 16, as well as between the high voltage generator 16 and the remaining electrical components of the device, are one or more circuit boards 12 containing any necessary auxiliary electrical componentry for ensuring effective and satisfactory functioning of the device. Such additional circuit board(s) 12 may comprise for example DC/AC (or vice versa) converters, as well as voltage adjustment means to control the high voltage applied to the nozzle (14).

In the upper region of the device is mounted reservoir 22 which is a bag-in-can means for containing the liquid cosmetic composition.

In fluid communication, via a conduit 26, with the reservoir 22 is a nozzle 14, which is connected electrically to the high voltage circuitry of the device so that the composition within the nozzle is raised to the high electric potential necessary to effect its egress from the nozzle under electrostatic forces and thus the electrostatic spraying thereof. The nozzle 14 comprises an internal chamber 17 which terminates at the tip of the nozzle in an annular slit 18 from which the product within the chamber 17 emerges under the influence of the electrostatic forces and passes through orifice 19. If desired or as necessary, the device may include feed means such as a pump (not shown in the Figure) to transfer composition from the reservoir 22 to the nozzle 14 at the required rate. Typically a positive pressure of from about 1 to 4 psi will be suitable for this purpose. The apparatuse is preferably provide with some kind of cap 30 for protecting the nozzle 14 when the apparatuse is not in use.

Shown schematically in FIG. 7 as 21 is a manual trigger which constitutes control means for selectively applying the high voltage to the nozzle to electrostatically spray the product therefrom.

What is claimed is:

1. A personal product comprising a liquid cosmetic composition suitable for application to the human body and a hand-held electrostatic spraying device suitable for applying a liquid cosmetic composition to the human body, said hand-held electrostatic spraying device comprising a slit nozzle having a maximum width of from 0.05 mm to 0.5 mm, means for containing the liquid cosmetic composition, means for supplying the liquid cosmetic composition to the nozzle, an electricity source, high voltage circuitry arranged so that, in use, liquid cosmetic composition sprayed in atomised form from the nozzle is electrically charged, and control means for selectively applying a high voltage ranging from about 25 to about 30 kV.

2. A personal product according to claim 1, wherein the slit nozzle is of uniform width along substantially its entire length.

3. A personal product according to claim 1, wherein the slit nozzle is outwardly curved at its ends.

4. A personal product according to claim 1, wherein the slit nozzle is curved along its length.

5. A personal product according to claim 4, wherein the nozzle has the form of an annular slit.

6. A personal product according to claim 1, wherein the nozzle cross-section has a ratio of length to width of from 10:1 to 500:1.

7. A personal product according to claim 1, wherein the nozzle cross-section has a ratio of length to width of from 100:1 to 500:1.

8. A personal product according to claim 1, wherein the nozzle has a width of from 0.2 mm to 0.4 mm.

9. A personal product according to claim 1, wherein the liquid cosmetic composition has a resistivity of from $10^4$ Ω.cm to $10^8$ Ω.cm.

10. A personal product according to claim 9, wherein the liquid cosmetic composition has a resistivity of from $10^6$ Ω.cm to $10^8$ Ω.cm.

11. A personal product according to claim 1, wherein the liquid cosmetic composition comprises ethanol and optionally water, the weight of ethanol to water being 1:1 or greater.

12. A personal product according to claim 1, further comprises an earthed ring electrode that surrounds the slit nozzle when viewed in the plane orthogonal to the general direction of movement of the liquid through the nozzle.

13. A method of spraying the human body with a liquid cosmetic composition, comprising the use of a hand-held electrostatic spraying device as described in claim 1, to spray the human body with a liquid cosmetic composition.

14. A method according to claim 13, wherein the liquid cosmetic composition exits the nozzle of the electrostatic spraying device having has a mean droplet size of from 5 μm to 50 μm.

15. A method according to claim 13, wherein the liquid cosmetic composition comprises a C2 to C4 alcohol.

16. A method according to claim 15, wherein the liquid or liquid cosmetic composition comprises ethanol and optionally water, the weight of ethanol to water being 1:1 or greater.

17. A method according to claim 13, wherein the liquid cosmetic composition is applied at a rate of from 30 ml/h to 500 ml/h.

18. A method according to claim 17, wherein the liquid cosmetic composition is applied at a rate of from 100 ml/h to 200 ml/h.

19. A method according to claim 13, wherein the liquid cosmetic composition is applied as a spray of Sauter D(3,2) mean droplet size of from 5 μm to 50 μm.

20. A method according to claim 13, wherein the liquid cosmetic composition is applied as a spray wherein 90% by volume of the droplets are from 5μm to 25 μm.

21. A personal product according to claim 1, wherein the liquid cosmetic composition is applied as a spray of Sauter D(3,2) mean droplet size of from about 6.1 to about 9.4 μm.

* * * * *